US006883737B2

(12) United States Patent
Fisch et al.

(10) Patent No.: US 6,883,737 B2
(45) Date of Patent: Apr. 26, 2005

(54) DEVICE FOR PROCESSING MATERIALS

(75) Inventors: Klaus Fisch, Gevelsberg (DE); Jens-Uwe Wichmann, Darmstadt (DE)

(73) Assignee: Cavitron v. Hagen & Funke GmbH, Sprickhoevel (DE)

( * ) Notice: Subject to any disclaimer, the term of this patent is extended or adjusted under 35 U.S.C. 154(b) by 249 days.

(21) Appl. No.: 10/226,338

(22) Filed: Aug. 23, 2002

(65) Prior Publication Data

US 2003/0042344 A1 Mar. 6, 2003

(30) Foreign Application Priority Data

Aug. 29, 2001 (DE) ..... 201 14 251 U
Aug. 29, 2001 (DE) ..... 201 14 253 U
Aug. 29, 2001 (DE) ..... 201 14 250 U

(51) Int. Cl.[7] ..... B02C 18/22
(52) U.S. Cl. ..... 241/248; 241/261.1
(58) Field of Search ..... 241/261, 261.1, 241/245, 248

(56) References Cited

U.S. PATENT DOCUMENTS 1,794,972 A * 3/1931 Mayer ..... 241/248

FOREIGN PATENT DOCUMENTS

| | | | |
|---|---|---|---|
| DE | 36 41 413 C1 | | 12/1986 |
| FR | 2607724 | * | 6/1988 |
| JP | 6-106089 | * | 4/1994 |

* cited by examiner

*Primary Examiner*—Mark Rosenbaum
(74) *Attorney, Agent, or Firm*—Diller, Ramik & Wight

(57) ABSTRACT

The device comprises a stator with gear rings and a rotor with teeth meshing with the teeth of the stator. Between arms of the rotor protrudes a guiding funnel that concentrates the material flow coming in from above to the central area of the container. The outer surface of the guiding funnel defines an annular gap throttling the material flow. At the rotor, a feed screw is provided that feeds towards the working region of the device. The guiding funnel retains the product in the active region of the device and the feed screw generates an increased material pressure in the center.

40 Claims, 5 Drawing Sheets

13
56
57
27
53
54
29
58
55

13
VI
VI
27
26
53
57
27
53

DEVICE FOR PROCESSING MATERIALS

BACKGROUND OF THE INVENTION

The invention relates to a device for processing materials, in particular for mixing, kneading, fibrillating, grinding and disintegrating, comprising a container enclosing a vertical container chamber with a product inlet at the top thereof, a stator with concentric gear rings arranged about a vertical axis, and a rotor with a plurality of arms having teeth meshing with the teeth of adjacent gear rings.

German Patent 36 41 413 describes a device for processing materials comprising a stator configured as an inner cone provided with gear rings. The stator cooperates with a rotor having arms projecting from a hub. Each of these arms bears teeth meshing with the teeth of the gear rings of the stator. With each turn of the rotor, the material to be processed is transported farther outward by one stage, while being subjected to an intensive shear effect, mixing and redistribution. The rotor arm and the subjacent container chamber of the upright device allow for a permanent rearrangement of the material from the inside to the outside and provide for a multiple processing of dry and/or highly viscous matter so that the device is of excellent utility for the intensive mixing, kneading, fibrillating, disintegrating and similar processes important in industrial production. The upright arrangement of the housing facilitates the material's falling back from the periphery toward the center of the device.

SUMMARY OF THE INVENTION

It is the object of the invention to develop a device of the above type with regard to an improvement of the guiding of the product.

In the present invention a guiding funnel is arranged in the container chamber above the rotor, the centric funnel opening of the guiding funnel having a smaller diameter than the rotor. The guiding funnel directs the material succeeding from above to the stator/rotor funnel to the center of the container and thus maintains the material in the active range of the tools. Moreover, it is made sure that the material gets into the active region of the tools in the vicinity of the axis, where It is moved outward on the inner cone of the stator while being processed by the teeth of the stator and the rotor. The guiding funnel thus guides the product into the active region of the device near the axis of the device.

Preferably, the funnel opening extends vertically into the rotor, i.e. into the area covered by the rotor arm movement. This means that the inner opening of the guiding funnel is at a lower level than the top edges of the rotor arms.

In a preferred embodiment of the invention the guiding funnel has an outer surface that is less steep that the inner surface. The outer or bottom surface of the guiding funnel, together with the inner cone surface of the stator, forms an annular space in which the product pushing outward is retained. Following this material retention is an expansion of the product due to the ever increasing diameter. Such a configuration of the guiding funnel promotes the redistribution and mixing of the material in the active region of the tool.

According to a preferred development of the invention the rotor has an axle stub projecting upward from a hub and bearing a feed screw. The feed screw conveys the product on its way from the top down and generates an additional pressure in the central region of the container. The feed screw is particularly well suited for the processing of heavily flowing products and viscous pastes. The diameter of the feed screw should suitably be somewhat larger than the diameter of the funnel opening.

The device of the present invention is also useful for the wet grinding of materials. The cooperating gear rings cause a pre-supply of energy into the material fed into the container from above, while heat is simultaneously dissipated through the housing.

In an advantageous embodiment of the invention the container is closed by a bottom wall having a receptacle for a carrier insert of the stator carrying the gear rings. The carrier insert is removably arranged in the receptacle. For cleaning or maintenance purposes, the carrier insert can be removed from the bottom wall as a whole towards the inside of the container after the rotor has been removed. Then, the stator can be dismantled and is available for cleaning, repair or maintenance. It is not necessary to dismantle the entire container. Rather, the container only has to be opened to have access to the carrier insert. This is done by taking off a lid of the container. The bottom wall is an integral part of the container and does not have to be removed. With the carrier insert removed, the container may also be subjected to cleaning and maintenance.

It is possible to replace the stator as a whole together with the carrier insert and the gear rings and to replace it with a new stator, for example, when the gear rings are worn or damaged.

In addition, the gear rings may be mounted to the carrier insert so as to be removable therefrom, each individual gear ring of the stator being adapted to be removed from the carrier body and to be replaced. Thus, repair work is considerably facilitated and economized, in particular in cases of broken teeth, since only the defect gear ring must be exchanged.

According to an advantageous development of the invention, each arm of the rotor consists of a carrier bar and a matching engaging toothed rack of hard metal. The carrier bar and the mesh in a matching fashion, i.e. positively, with either the carrier bar or the toothed rack being the embracing member and the respective other element forming the inner member of the meshing engagement. Thereby, it is achieved that the toothed rack and the carrier bar are each pressed against each other along a surface, whereby the pulling force applied upon rotation of the rotor is distributed over a surface. As known, hard metal is a brittle material with low strength against tensile stresses and bending stresses. The invention achieves that no major tensile or bending stresses occur in the toothed bar. Such stresses only occur in the carrier bar that may be made of steel of great tensile strength.

It is another advantage that the toothed rack can be assembled to the carrier bar under different orientations. If, given a rotation of the rotor in a first sense of rotation, the front edges of the teeth of the toothed rack are worn down, the operation of the device can be continued if the rotation follows a second sense of rotation opposite to the first sense of rotation. In this way, the very expensive hard metal toothed bar is used more efficiently.

BRIEF DESCRIPTION OF THE DRAWINGS

The following is a detailed description of an embodiment of the invention with reference to the drawings.

In the figures.

DESCRIPTION OF PREFERRED EMBODIMENTS

Figure 1:
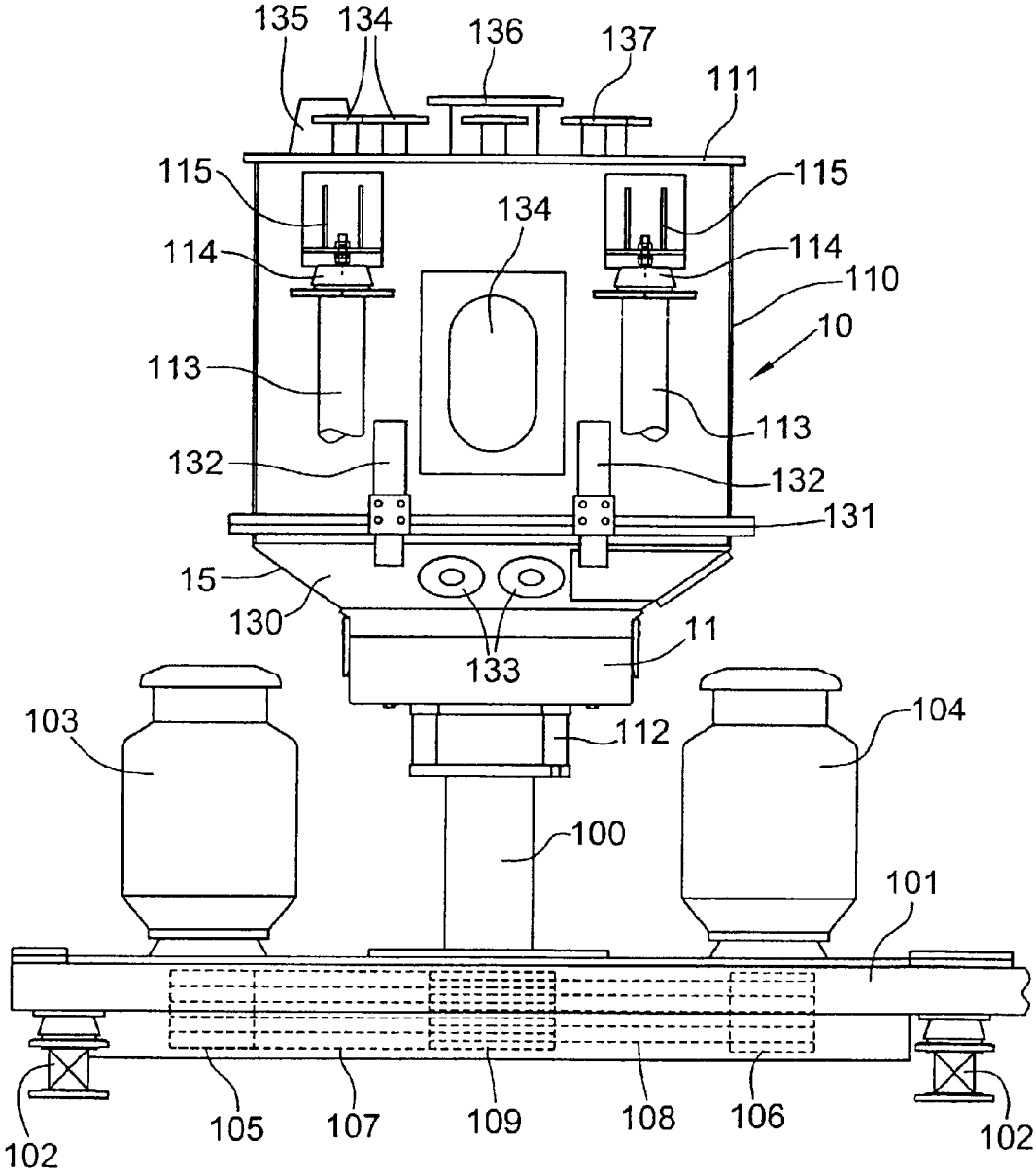
FIG. 1 is a side elevational view of the device.

The device comprises a container 10 having a diameter of 600 mm, for example, and being mounted vertically upright on a column 100. As illustrated in FIG. 1, the column 100 is mounted on a base 101 which stands on the ground on supporting blocks 102. Mounted on the base 101 are two electric motors 103, 104 with vertical axes. Each electric motor drives a pulley 105, 106 arranged within the base 101. The pulleys 105, 106 drive a pulley 109 via drive belts 107, 108, which pulley is connected to the shaft of the device supported in the column 100.

The container 10 comprises an upper container portion 110 closed at the top end with a lid 111. Contiguous to the lower end of the container portion 110, seen in side elevational view, is a trapezoidal transition wall 15 ending in a bottom wall 11. Below the bottom wall a barrier liquid housing 112 is provided to which a supply line and a discharge line for barrier liquid is connected. The barrier liquid housing 110 is supported by the column 100.

The container 10 is supported by vertical posts 113 whose lower ends are fastened to the base 101 and whose upper ends bear rubber buffers 114. Supporting bearings 115 are mounted to the container portion 110, which rest on the rubber buffers so that the container 10 is suspended from the posts 113, so to speak.

Figure 2:
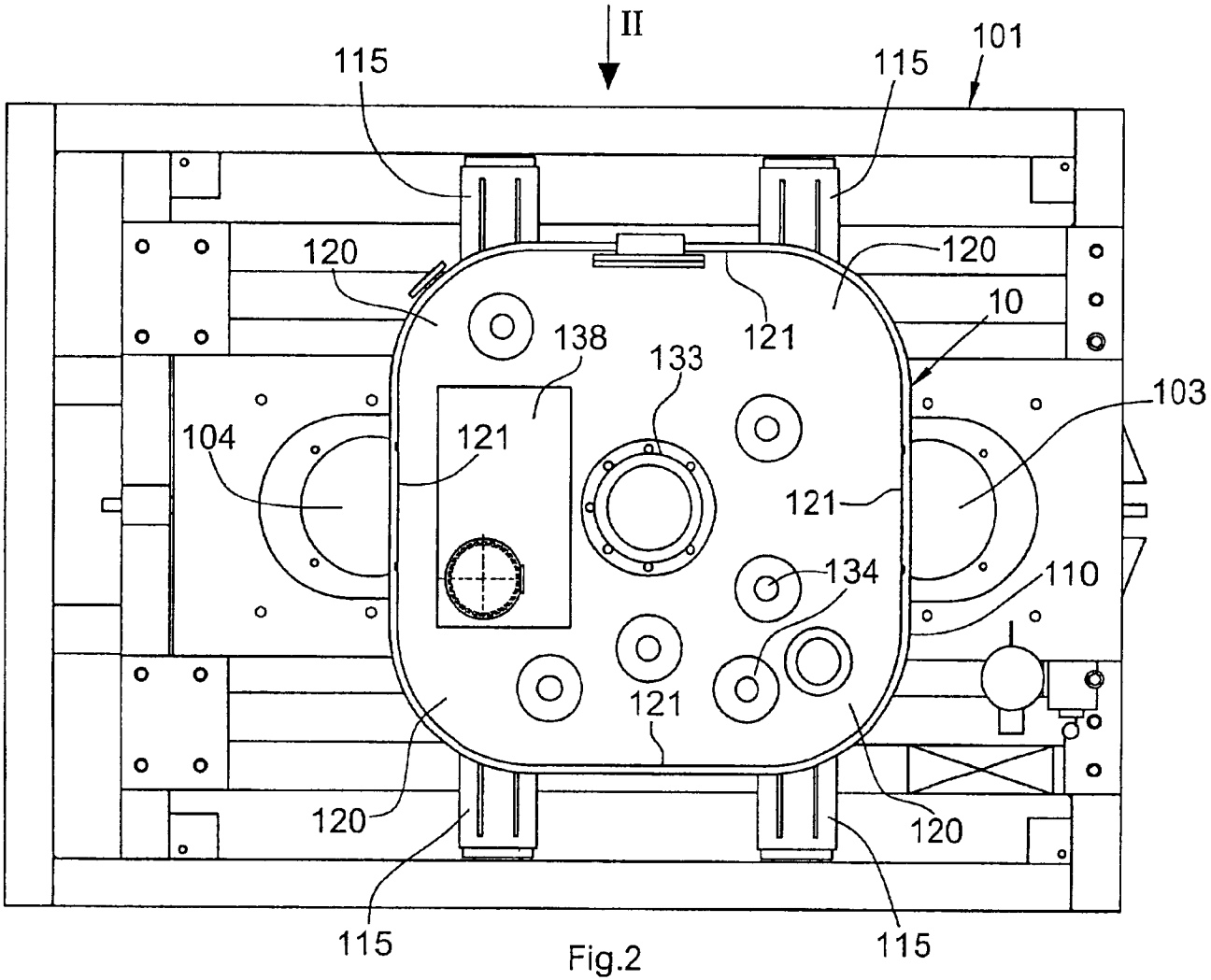
FIG. 2 is a top plan view of the device of FIG. 1.

As illustrated in FIG. 2, the container portion 110 has a rectangular—or square—shape in plan view. Corner portions 120 are formed that are rounded and extend over an angle of 90 degrees, respectively, and straight edge portions 121 are formed that connect the corner portions.

Although FIG. 2 only illustrates the outer shape of the container 10, it is evident that the inner shape also has a quadrangular shape with rounded corners. Since the distance of the side wall of the container from the mixing member rotating inside the container varies in the circumferential direction, material pile-up occurs in the corner portions 120 that dissolve into a material flow directed towards the center. The alternation of straight edge portions 121 and round corner portions 120 prevents the viscous mass from merely rotating in the container chamber. Radially inward directed flows are generated that cross the rotating flow, thereby causing an intensive mixing.

The container portion 110 is detachably connected with the truncated lower portion 130 through a flange connection 131. The flange connection 131 is retained by power tighteners 132 that may be opened to dismantle the container.

The lower portion 130 is provided with blind flanges 133 for fastening measuring instruments. An overflow 134 is provided at the outer wall of the container portion 110.

In the center of the container lid 111 a product inlet 136 is provided through which the product to be processed is fed vertically into the container 10. Moreover, other inlet nozzles 137 through which additives can be supplied. Finally, an inspection opening 135 is provided at the lid 111. An access opening is closed by a door 138 in the lid 111 (FIG. 2).

Figure 3:
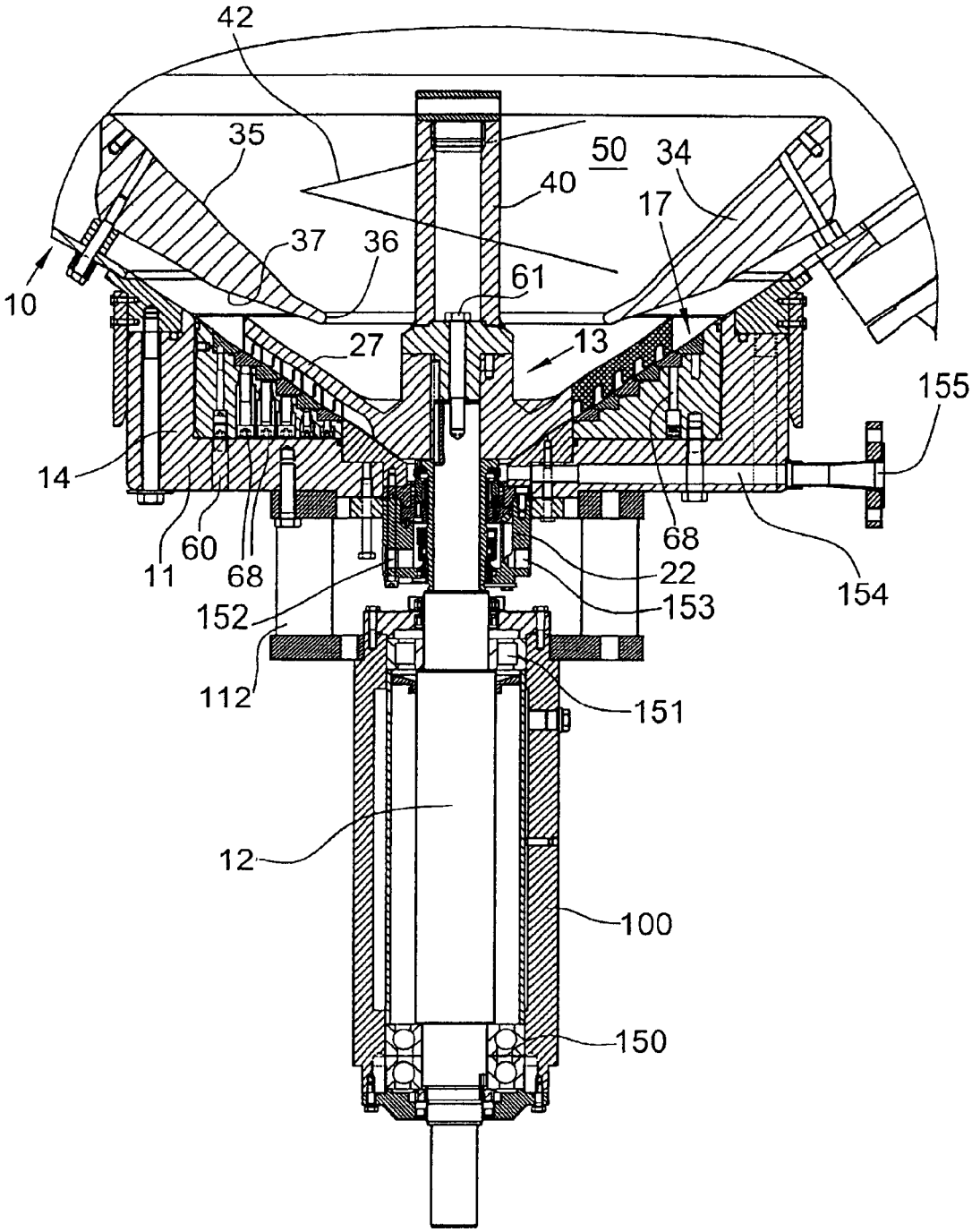
FIG. 3 is an enlarged longitudinal section of the lower portion of the container, the sealing of the shaft passage and the bearing of the shaft.

FIG. 3 illustrates the column 100 with the shaft 12 passing therethrough. Bearings 150, 151 support the shaft in the column 100. The passage of the shaft 12 through the bottom wall 11 is sealed by a sealing 22. The sealing 22 has an inlet 152 and an outlet 153 for barrier liquid.

A channel 154 extends through the bottom wall 11 of the housing 10 to an connector 155 for draining residuals. Via the channel 154 fluid sinking to the lowest point of the container chamber 50 is drained from the container chamber.

Figure 4:
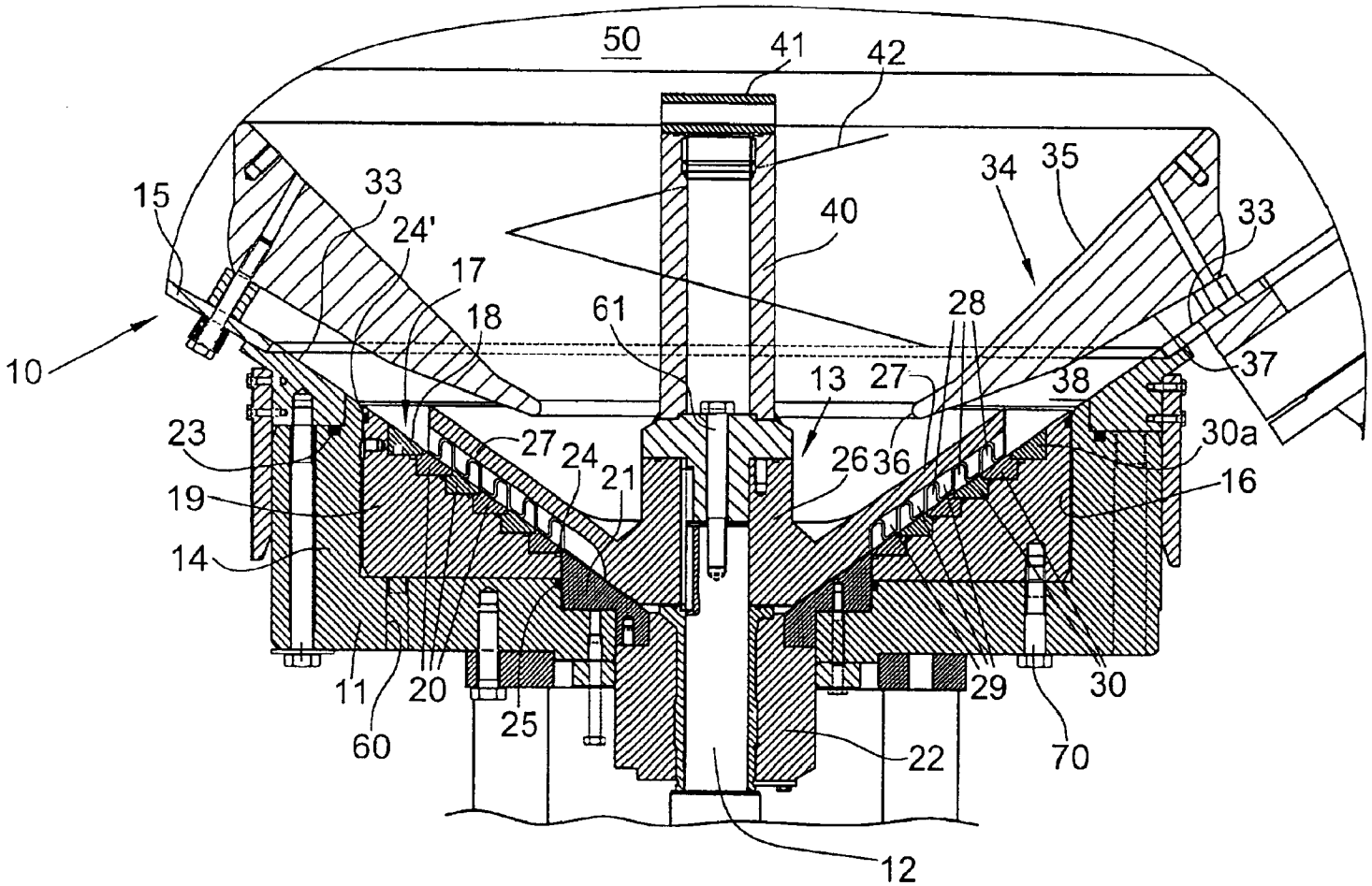
FIG. 4 is a schematic illustration in an even larger scale of the lower container portion with stator and rotor, as well as the guiding funnel and the feed screw.

As is evident from FIGS. 3 and 4, the bottom wall 11 has a circumferentially extending upright edge 14 to which the inclined transition wall 15 of the container 10 is fastened. The bottom wall 11 and its edge 14 define an annular receptacle 16 in which an annular stator 17 is arranged. The stator 17 has a working surface 18 formed as an inner cone or inner pyramid. Half of the annular cross section of the stator 17 has the general shape of a rectangular triangle with the working surface 18 forming the hypotenuse. The stator 17 is comprised of an annular carrier insert 19 fittingly received in the receptacle 16 and a plurality of gear rings 20 arranged along the working surface 18. Towards the interior the receptacle 16 is defined by an inner annular insert 21 forming the passage of the shaft 12 sealed with the sealing 22. On the outer circumference the carrier insert 19 is sealed against the circumferential wall of the receptacle 16 by an annular sealing 23. On the inner circumference the carrier insert is sealed with two annular seals 24, 24' and 25 against the inner annular insert 21 defining the receptacle 16 toward the inside. Thus, it is prevented that the mass to be processed protrudes to behind the carrier insert 19. At the outer circumference the carrier insert 19 has a further annular seal 24' to seal it against the edge 14 of the bottom wall 11.

The rotor 13 comprises a hub 26 fastened on the shaft 12 and a plurality of arms 27 projecting radially from the hub. The arms 27 have downward directed teeth 29 meshing with teeth 28 of the gear rings 20 of the stator. The teeth 28 project upward from each of the gear rings 20. The teeth 29 of the rotor 13 engage the gaps between the gear wheels 20 of the stator 17. The teeth 28 of each gear ring 20 are spaced circumferentially.

The teeth 28 and 29 consist of wear-resistant material, in particular hard metal. In the stator 17, the carrier rings 30 with the integrally formed teeth 28 are made of hard metal.

Figures 5, 6:
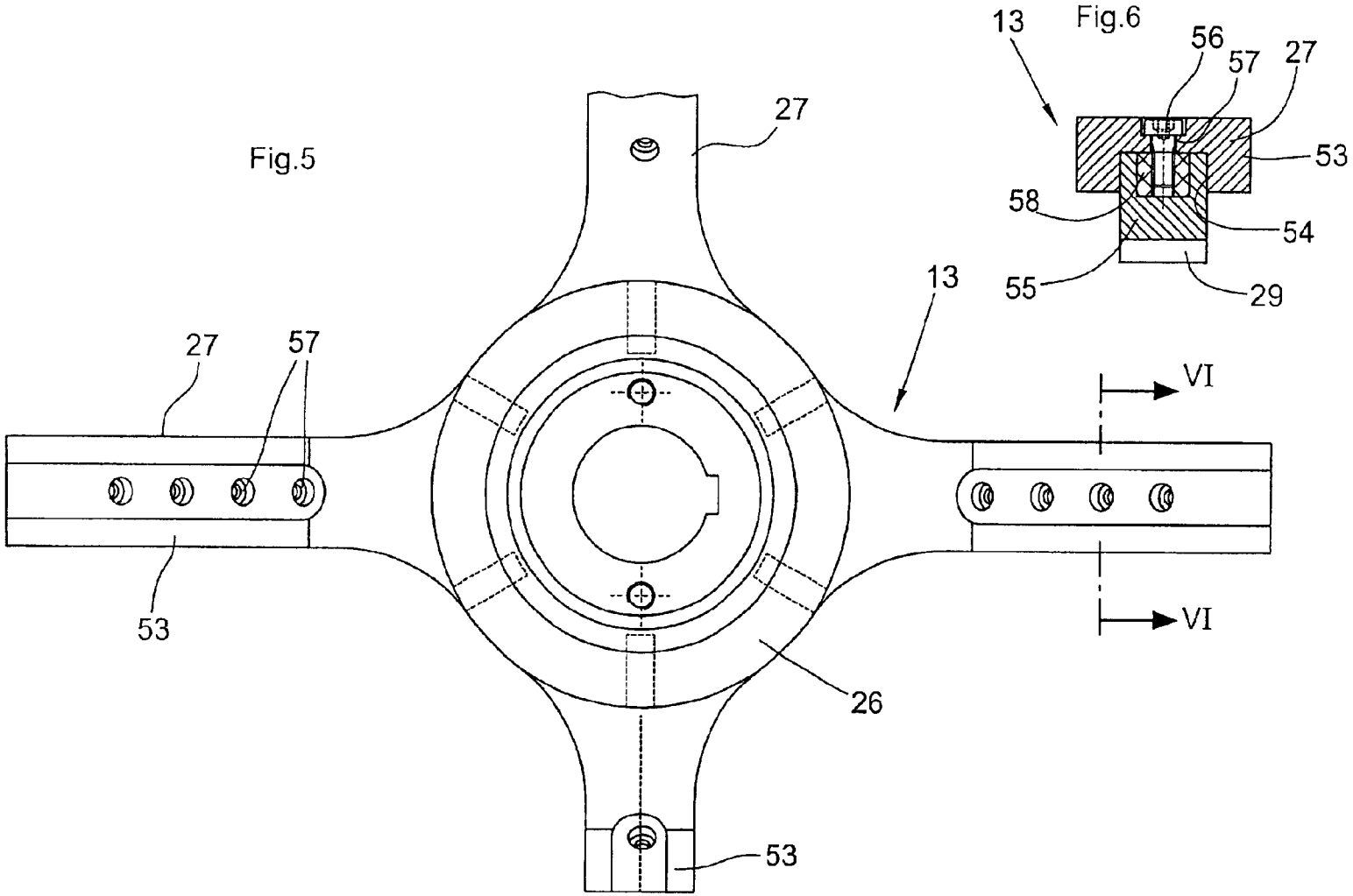
FIG. 5 is a bottom view of the rotor in partial section and FIG. 6 is a section along line VI—VI of the rotor.

The working surface 18 of the stator 17 formed as an inner cone continues outward with substantially the same cone angle in the transition surface 33 of the transition wall 15 so that the material that has passed the teeth 18, 29 is pressed upward and outward along the working surface 18 and the transition surface 33. As illustrated in FIG. 6 each arm 27 of the rotor 13 comprises a support bar 53 of generally U-shaped cross section. The support bar 53 has its oblique bottom surface provided with a longitudinal groove 54 of rectangular cross section in which a toothed rack 55 is accommodated. The support bar 53 is made of high-strength steel, whereas the toothed rack 55 is made of hard metal. The back of the toothed rack 55 fills the groove 54 completely with a tight fit. The teeth 29 are situated on the part of the toothed rack 55 protruding from the groove 54.

In addition, the toothed rack 55 is fixed with screws 56 passed through bores 57 of the support bar 63, their thread being screwed into a threaded insert 58 sunk into the toothed rack 55. The threaded insert 58 is made of steel and is soldered into the toothed rack 55. By loosening the screws 56 provided at regular intervals along one arm 27, the toothed rack 55 can be dismantled.

It is possible to replace individual toothed racks 55 of one or more teeth are damaged. To this end, the rotor 13 can be dismantled from the shaft 12 and pulled off towards the interior of the container.

During operation of the device the front edges of the teeth 29—seen in the direction of rotation—are worn particularly heavily. When the front edges of the teeth are worn down, the toothed rack 55 is taken from the support bar 53 and inserted in a turned around orientation with the former front edges now being directed rearward, the reversible drive of the shaft 12 is adjusted to the inversed rotation and the rotor 13 is driven in the opposite sense of rotation. Thus, both the teeth of the rotor 13 and those of the stator 17 can be used twice. The exploitation of the expensive hard metal is thereby improved.

The carrier rings 30 of the stator 17 that form the oblique working surface 18 overlap such that the respective outer carrier ring partly covers the adjacent inner carrier ring of smaller diameter and holds the same down in the respective recess of the carrier insert 19. The outermost ring 30*a* that holds down the adjacent inner carrier ring 30 is made of stainless steel and has no teeth. It is held at the carrier insert 19 by a screw. The outer ring 30*a* thus forms the blocking element for all carrier rings 30.

The carrier insert 19 can be taken from the receptacle 16. This is done by pushing screws (not illustrated) that are screwed into threaded bores 60 in the bottom wall 11 and which push against the underside of the carrier insert 19. For example, a total of four threaded bores 60 for pushing screws are equally distributed in the bottom wall 11. By turning the pushing screws uniformly, the carrier insert 19 is pushed up into the container chamber 50. Before this happens, the rotor 13 must be removed, of course. This is effected by loosening the screw 61 that retains the rotor 13 on the shaft 12. For access to the screw 61, the closing stopper 41 is unscrewed from the shaft stub 40.

After the stator 17 has been taken from the container 10, each individual gear ring 20 can be loosened from the carrier insert 19. To this end, each gear ring 20 is associated to a threaded bore 68 within the carrier insert (FIG. 3) in which a pushing screw is accommodated. The pushing screws are accessible for turning from the lower side of the carrier insert 19 and they may be turned to push the respective gear ring 20 from the respective recess of the carrier insert 19. Thus, it is possible to replace each of the gear rings 20 individually. The stator 17 is held in the receptacle 16 by retaining screws 70 that are screwed through the bottom wall 11 into the carrier insert 19. The retaining screws 70 can be loosened to loosen the carrier insert.

Inside the container 10, a guiding funnel 34 is mounted at a distance from the transition wall 15. The guiding funnel 34 has a funnel-shaped inner surface 35 terminating in a funnel opening 36 at the lower end of the guiding funnel. The funnel opening 36 protrudes from above into the chamber defined by the arms 27 of the rotor and it has a smaller diameter than the rotor 13. The material fed and following into the container from above is concentrated towards the area of the hub 26, i.e. towards the central area, by the funnel opening 36. There, the material gets between the arms 27 of the rotor 13 and arrives in the area of the teeth.

The guiding funnel 34 has an outer surface 37 that is less steep than the inner surface 35. Thus, the guiding funnel 34 has a thickness increasing with the diameter. The outer surface 37, together with the transition surface 33, forms an annular gap 38 in projection of the arms 27 of the rotor 13. The height of the annular gap 38 decreases outward. In the annular gap 38, the outward conveyed material piles up so that the transport action by the teeth 28, 29 is met with a resistance. Thus, the shearing, grinding and mixing action of the teeth is reinforced.

In projection of the shaft 12, the hub 26 is provided with an upward protruding shaft stub 40 that is tubular and is closed by a closure 41. The shaft stub 40 bears a feed screw 42 with one or two threads. Upon rotation of the driven shaft 12, the feed screw conveys from the top down, i.e. towards the hub. 26. The diameter of the feed screw 42 is slightly larger than that of the funnel opening 36. The feed screw 42 generates an increased pressure in the center, i.e. around the rotor 13.

Although a preferred embodiment of the invention has been specifically illustrated and described herein, it is to be understood that minor variations may be made in the apparatus without departing from the spirit and scope of the invention, as defined by the appended claims.

What is claimed is:

1. A device for processing materials comprising a container including a vertical container chamber having a product inlet at a top, a stator with concentric gear rings arranged about a vertical axis, a rotor with a plurality of arms with teeth engaging between adjacent teeth of said concentric gear rings, a guiding funnel arranged in the container chamber above the rotor, a funnel opening of said guiding funnel having a smaller diameter than the rotor, and the guiding funnel having an outer surface that is less steep than an inner surface.

2. The device of claim 1, characterized in that the funnel opening protrudes into the rotor.

3. The device of claim 1, characterized in that the rotor has a shaft stub projecting upward from a hub and bearing a feed screw.

4. The device of claim 1, characterized in that the container is closed by a bottom wall, and a carrier insert of the stator carrying the gear rings is removably arranged in a receptacle of the bottom wall.

5. The device of claim 4, characterized in that the bottom wall is provided with threaded bores for pushing screws serving to push the carrier insert into the container chamber.

6. The device of claim 5, characterized in that seals are provided at inner and outer circumferences of the carrier insert between the receptacle and the carrier insert which prevent material from entering beneath the carrier insert.

7. The device of claim 4, characterized in that seals are provided at inner and outer circumferences of the carrier insert between the receptacle and the carrier insert which prevent material from entering beneath the carrier insert.

8. The device of claim 4, characterized in that the gear rings are removably fastened to the carrier insert.

9. The device of claim 8, characterized in that each gear ring has a carrier ring and that a respective carrier ring overlaps and holds down an adjacent carrier ring.

10. The device of claim 9, characterized in that the carrier insert is provided with threaded bores for pushing screws adapted to push out the individual gear rings.

11. The device of claim 8, characterized in that the carrier insert is provided with threaded bores for pushing screws adapted to push out the individual gear rings.

12. The device of claim 4, characterized in that the stator has an inner annular insert fastened to the bottom wall separate of the carrier insert and defining the receptacle.

13. The device of claim 1, characterized in that each arm of the rotor includes a support bar and a meshing toothed rack of hard metal.

14. The device of claim 13 characterized in that the support bar has a longitudinal extending channel in which the toothed rack is removably attached.

15. The device of claim 13, characterized in that the toothed rack has a threaded insert and is fastened to the support bar by a screw.

16. The device of claim 1, characterized in that a drive of the rotor (13) is reversible.

17. The device of claim 1, characterized in that the container chamber of the container has a polygonal plan shape such that corner portions that are spaced farther from the rotor alternate with edge portions that are spaced a lesser distance from the rotor.

18. A device for processing materials comprising a container including a vertical container chamber having a product inlet at a top, a stator with concentric gear rings arranged about a vertical axis, a rotor with a plurality of arms with teeth engaging between adjacent teeth of said concentric gear rings, a guiding funnel arranged in the container chamber above the rotor, a funnel opening of said guiding funnel having a smaller diameter than the rotor, the funnel opening protrudes into the rotor, and the guiding funnel has an outer surface that is less steep than an inner surface.

19. A device for processing materials comprising a container including a vertical container chamber having a product inlet at a top, a stator with concentric gear rings arranged about a vertical axis, a rotor with a plurality of arms with teeth engaging between adjacent teeth of said concentric gear rings, a guiding funnel arranged in the container chamber above the rotor, a funnel opening of said guiding funnel having a smaller diameter than the rotor, and an outer surface of the guiding funnel and an inclinded bottom surface of the container forms an annular gap for piling up material flow.

20. The device of claim 19, characterized in that the funnel opening protrudes into the rotor.

21. The device of claim 19, characterized in that the rotor has a shaft stub projecting upward from a hub and bearing a feed screw.

22. The device of claim 19, characterized in that the container is closed by a bottom wall, and a carrier insert of the stator carrying the gear rings is removably arranged in a receptacle of the bottom wall.

23. The device of claim 22, characterized in that the bottom wall is provided with threaded bores for pushing screws serving to push the carrier insert into the container chamber.

24. The device of claim 22, characterized in that seals are provided at inner and outer circumferences of the carrier insert between the receptacle and the carrier insert which prevent material from entering beneath the carrier insert.

25. The device of claim 22, characterized in that the gear rings are fastened to the carrier insert.

26. The device of claim 25, characterized in that each gear ring has a carrier ring and that a respective carrier ring overlaps and holds down an adjacent carrier ring.

27. The device of claim 25, characterized in that the carrier insert is provided with threaded bores for pushing screws adapted to push out the individual gear rings.

28. The device of claim 22, characterized in that the stator has an inner annular insert fastened to the bottom wall separate of the carrier insert and defining the receptacle.

29. The device of claim 19, characterized in that each arm of the rotor includes a support bar and a meshing toothed rack of hard metal.

30. The device of claim 29, characterized in that the support bar has a longitudinal extending channel in which the toothed rack is detachably attached.

31. The device of claim 29, characterized in that the tooth rack has a threaded insert and is fastened to the support bar by a screw.

32. The device of claim 19, characterized in that a drive of the rotor (13) is reversible.

33. The device of claim 19, characterized in that the container chamber of the container has a polygonal plan shape such that corner portions that are spaced farther from the rotor alternate with edge portions that are spaced a lesser distance from the rotor.

34. A device for processing materials comprising a container including a vertical container chamber having a product inlet at a top, a stator having a working surface formed as an inner cone with concentric gear rings arranged about a vertical axis, a transition surface of said stator merging with said stator working surface, a rotor with a plurality of arms with teeth engaging between adjacent teeth of said concentric gear rings, an overflow in an upper container portion above the stator working surface and the stator transition surface, a guiding funnel in the container chamber above the rotor, a funnel opening of the guiding funnel having a smaller diameter than an adjacent opening of the rotor, and said funnel and stator transition surface defining an annular gap through which processed material passes to said overflow.

35. The device of claim 34, characterized in that the funnel opening protrudes into the rotor.

36. The device claim 34, characterized in that the guiding funnel has an outer surface that is less steep than the inner surface.

37. The device of claim 34, characterized in that the rotor has a shaft stub projecting upward from a hub and bearing a feed screw.

38. The device of claim 34, characterized in that the container is closed by a bottom wall, and a carrier insert of the stator carrying the gear rings is removably arranged in a receptacle of the bottom wall.

39. The device of claim 38, characterized in that the bottom wall is provided with threaded bores for pushing screws serving to push the carrier insert into the container chamber.

40. The device of claim 38, characterized in that seals are provided at inner and outer circumferences of the carrier insert between the receptacle and the carrier insert which prevent material from entering beneath the carrier insert.

* * * * *